US009786414B2

(12) United States Patent
Chiou et al.

(10) Patent No.: US 9,786,414 B2
(45) Date of Patent: Oct. 10, 2017

(54) CABLE

(71) Applicant: Wistron Corporation, New Taipei (TW)

(72) Inventors: Sheng-Lun Chiou, New Taipei (TW); Yin-Yu Chen, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 14/946,788

(22) Filed: Nov. 20, 2015

(65) Prior Publication Data

US 2017/0047148 A1 Feb. 16, 2017

(30) Foreign Application Priority Data

Aug. 10, 2015 (TW) ..... 104125893 A

(51) Int. Cl.
*H01R 9/05* (2006.01)
*H01B 11/08* (2006.01)
*H01B 11/12* (2006.01)

(52) U.S. Cl.
CPC ..... *H01B 11/08* (2013.01); *H01B 11/12* (2013.01)

(58) Field of Classification Search
CPC ..... H01B 11/002; H01R 9/0512
USPC ..... 174/27, 75 C, 78
See application file for complete search history.

(56) References Cited

U.S. PATENT DOCUMENTS 5,831,210 A 11/1998 Nugent
6,809,256 B2 * 10/2004 Garland ..... H01B 3/441 174/102 R
7,034,229 B2 * 4/2006 Victor ..... H01B 11/12 174/110 R
9,253,875 B2 * 2/2016 Lent ..... H04B 3/32
9,316,801 B1 * 4/2016 Kithuka ..... G02B 6/4495
2007/0163800 A1 7/2007 Clark et al.
2013/0161071 A1 * 6/2013 Kodama ..... H05K 1/18 174/250

FOREIGN PATENT DOCUMENTS

CN 101371319 2/2009
CN 103069506 4/2013
CN 104240838 12/2014
TW M472295 2/2014

OTHER PUBLICATIONS

"Office Action of Taiwan Counterpart Application" with partial English translation, dated Jun. 20, 2016, p. 1-p. 10.
"Office Action of China Counterpart Application," dated Aug. 2, 2017, with English translation thereof, p. 1-p. 15, in which the listed reference was cited.

* cited by examiner

*Primary Examiner* — Chau N Nguyen
(74) *Attorney, Agent, or Firm* — Jianq Chyun IP Office

(57) ABSTRACT

A cable including a first insulating layer, a twisted pair, a ground structure, and at least one conducting element is provided. The twisted pair is disposed in the first insulating layer and includes two signal wires, wherein the two signal wires are intertwisted to each other. The ground structure is disposed at the first insulating layer. The conducting element includes a main body portion and at least one extending portion. The main body portion is disposed in the twisted pair to be surrounded by the two signal wires. The extending portion is connected to the main body portion and grounded to the ground structure.

8 Claims, 8 Drawing Sheets

CABLE

CROSS-REFERENCE TO RELATED APPLICATION

This application claims the priority benefit of Taiwan application Ser. No. 104125893, filed on Aug. 10, 2015. The entirety of the above-mentioned patent application is hereby incorporated by reference herein and made a part of this specification.

BACKGROUND OF THE INVENTION

1. Field of the Invention

The invention is related to a cable, and particularly to a cable with a twisted pair.

2. Description of Related Art

Cables are commonly used in electronic devices to transmit signals. For example, a wireless module, a camera module, a keyboard, a battery, and other modules of a computer can be electrically connected to a central processing unit (CPU) through cables.

If a cable does not have good signal integrity, then the problem of electromagnetic interference (EMI) or radio frequency interference (RFI) may occur. In order to solve the problems caused by poor signal quality in cables, a circuit board will usually have an additional filter. Or, the cable will additionally be directly wrapped with thicker shielding layers. However, this not only increases the production cost and time of the electronic device, it also reduces the amount of useable space in the electronic device.

SUMMARY OF THE INVENTION

The invention provides a cable, having better signal quality.

The cable of the invention includes a first insulating layer, a twisted pair, a ground structure, and at least one conducting element. The twisted pair is disposed in the first insulating layer and includes two signal wires. The two signal wires are intertwisted with each other. The ground structure is disposed at the first insulating layer. The conducting element includes a main body portion and at least one extending portion. The main body portion is disposed in the twisted pair to be surrounded by the two signal wires. The extending portion is connected to the main body portion and grounded to the ground structure.

In an embodiment of the invention, the ground structure includes a metal layer. The metal layer is disposed at an inner wall of the first insulating layer. The extending portion extends out of the twisted pair to connect to the metal layer.

In an embodiment of the invention, the ground structure includes a metal housing. The metal housing is disposed at an end of the first insulating layer. The conducting element is connected to the metal housing.

In an embodiment of the invention, the at least one extending portion is a plurality of extending portions. The extending portions respectively extend along different directions to connect to the ground structure.

In an embodiment of the invention, the at least one conducting element is a plurality of conducting elements. A length, material, or shape of the main body portion of one of the conducting elements is different from a length, material, or shape of the main body portion of another one of the conducting elements.

In an embodiment of the invention, the two signal wires are symmetric about the main body portion.

In an embodiment of the invention, each of the signal wires includes a conductive wire and a second insulating layer. The second insulating layer covers the conductive wire.

In an embodiment of the invention, the cable further includes at least one third insulating layer. The third insulating layer covers the main body portion of the conducting element.

Based on the above, in the cable of the invention, the conducting element is disposed between the two signal wires of the twisted pair, and the conducting element is grounded. Accordingly, the conducting element can filter a common mode signal of the twisted pair. This allows the differential mode signal of the twisted pair to not be distorted, which improves the signal integrity of the cable. Thus, the problems of EMI or RFI are reduced.

To make the above features and advantages of the present invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
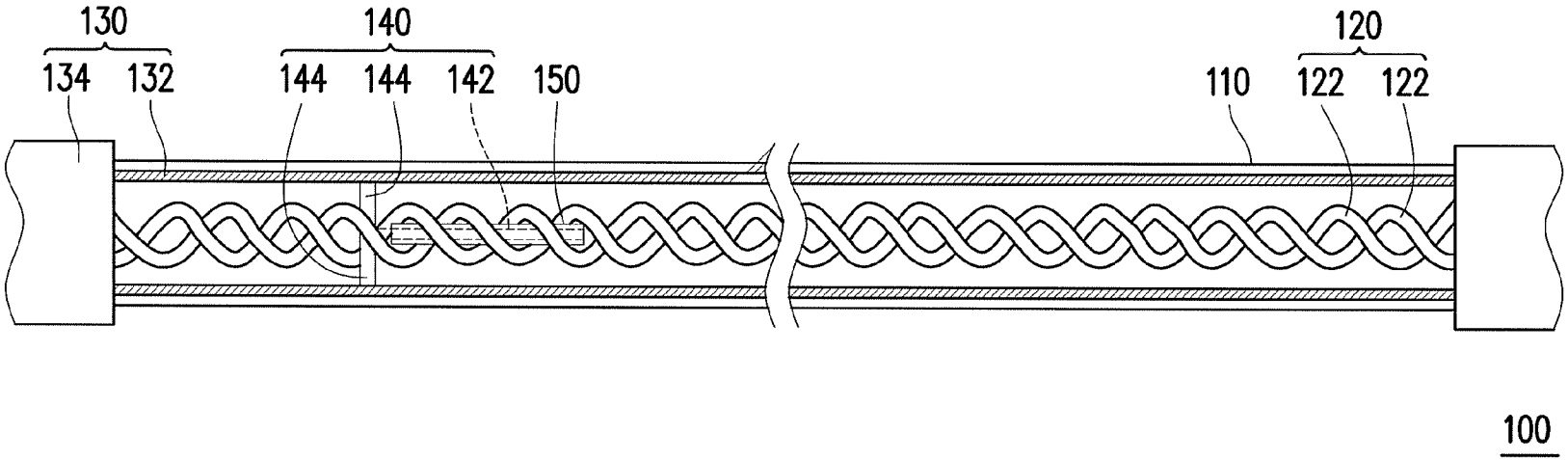
FIG. 1 is a schematic view of a cable according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a schematic view of a cable according to an embodiment of the invention. In order to make the figures clearer, a first insulating layer 110 and a metal layer 132 of FIG. 1 are shown by a cross-sectional view. In the embodiment, a cable 100 is, for example, used to provide electrical connections between different modules in an electronic device, or used to provide electrical connections between other types of components. The invention is not limited thereto. Referring to FIG. 1, the cable 100 includes a first insulating layer 110, a twisted pair 120, a ground structure 130, and at least one conducting element 140. The twisted pair 120 is disposed in the first insulating layer 110 and includes two signal wires 122. The two signal wires 122 are intertwisted with each other. The ground structure 130 is disposed at the first insulating layer 110. The conducting element 140 includes a main body portion 142 and at least one extending portion 144. The main body portion 142 is disposed in the twisted pair 120 to be surrounded by the two signal wires 122. The two signal wires 122 are, for example, symmetric about the main body portion 142. The extending portion 144 is connected to the main body portion 142 and grounded to the ground structure 130.

Figure 2:
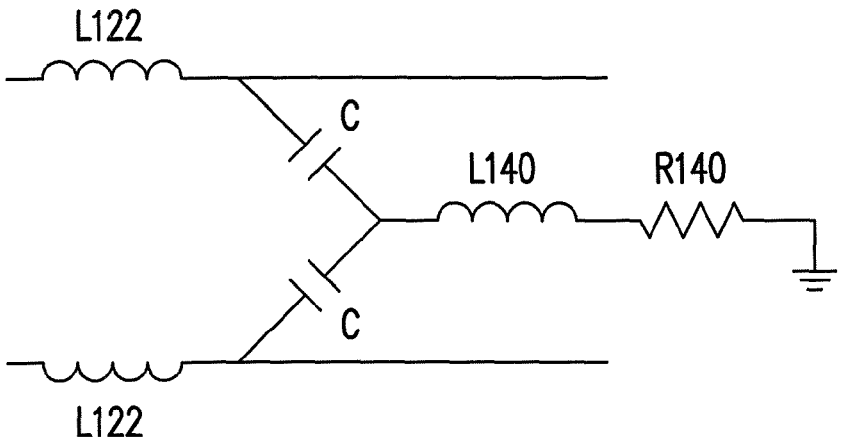
FIG. 2 shows a circuit diagram of the twisted pair and the conducting element of FIG. 1.

FIG. 2 shows a circuit diagram of the twisted pair and the conducting element of FIG. 1. Referring to FIG. 1 and FIG. 2, each of the signal wires 122 includes an inductance L122. The conducting element 140 includes an inductance L140 and a resistance R140. A parasitic capacitance C is between each of the signal wires 122 and the main body portion 142. As mentioned above, the conducting element 140 is disposed between the two signal wires 122 of the twisted pair 120. The conducting element 140 is connected to ground as seen in the circuit diagram of FIG. 2. This way, the conducting element 140 can filter a common mode signal of the twisted pair 120. This allows the differential mode signal of the twisted pair 120 to not be distorted, which improves the signal integrity of the cable 100. Thus, the problems of EMI or RFI in the cable 100 are reduced. For example, when the signal wires 122 generate common mode signals, the common mode signals will be affected by the parasitic capacitance C and the inductance L140 to nullify each other. The partially remaining common mode signals will be directed to a ground terminal because of the resistance R140.

Referring to FIG. 1, in detail, the ground structure 130 includes a metal layer 132 and a metal housing 134 electrically connected to each other. The metal housing 134 is, for example, a casing of a connector at an end of the cable 100. The metal layer 132 is disposed at an inner wall of the first insulating layer 110. Each of the extending portions 144 of the conducting element 140 extends out of the twisted pair 120 to connect to the metal layer 132, so as to achieve a grounding effect.

In the embodiment, the extending portion 144 of the conducting element 140 is a plurality of extending portions 144 (two are shown). The extending portions 144 respectively extend along different directions to connect to the ground structure 130. This allows the conducting element 140 to be stably disposed in the first insulating layer 110. In other embodiments, the extending portions 144 may be any other suitable amount, and extend in other suitable directions according to design requirements. The invention is not limited thereto.

Figure 3:
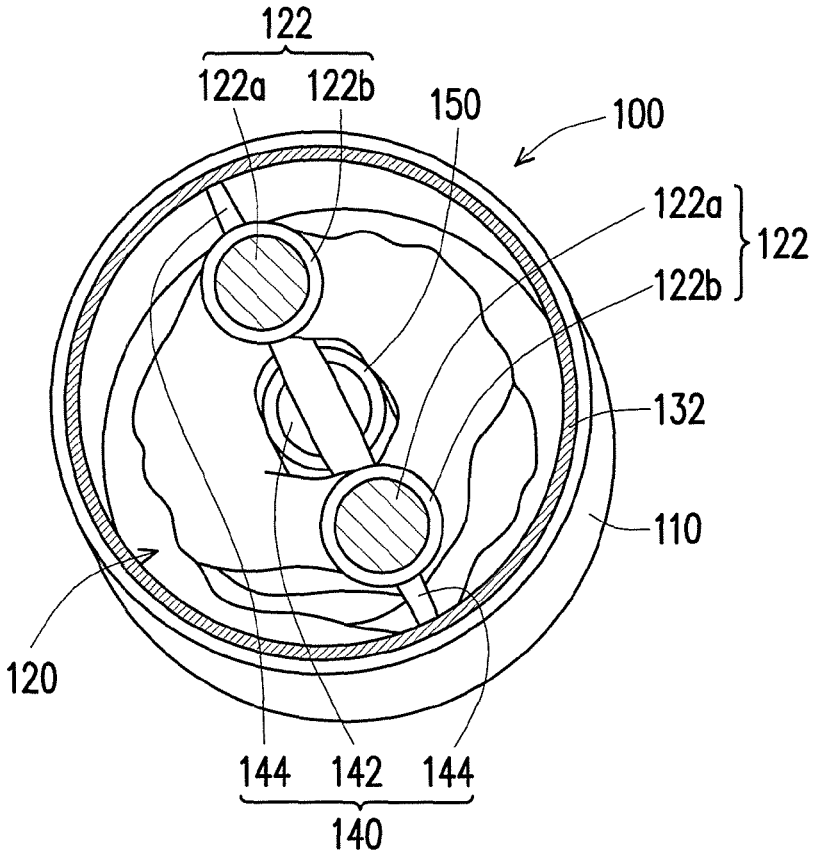
FIG. 3 is a partial three-dimensional diagram of the cable of FIG. 1 according to a viewing angle.
Figure 4:
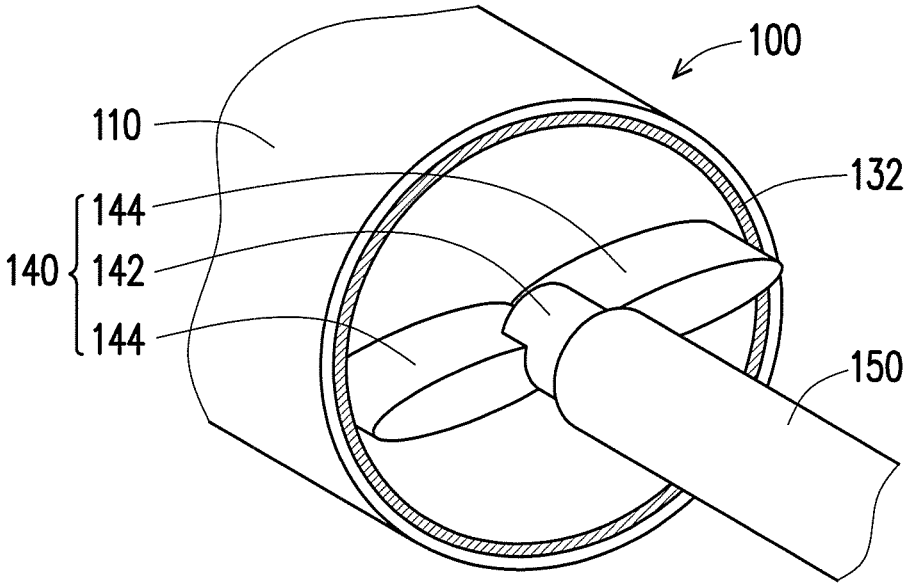
FIG. 4 is a partial three-dimensional diagram of the cable of FIG. 1 according to another viewing angle.

FIG. 3 is a partial three-dimensional diagram of the cable of FIG. 1 according to a viewing angle. FIG. 4 is a partial three-dimensional diagram of the cable of FIG. 1 according to another viewing angle. In order for the figures to be clearer, FIG. 4 does not show the twisted pair 120 in FIG. 3. Referring to FIG. 3 and FIG. 4, in the embodiment, each of the signal wires 122 includes a conductive wire 122*a* and a second insulating layer 122*b*. The second insulating layer 122*b* covers the conductive wire 122*a*. In addition, the cable 100 further includes at least one third insulating layer 150. The third insulating layer 150 covers the main body portion 142 of the conducting element 140. Since the second insulating layer 122*b* covers the conductive wire 122*a*, and the third insulating layer 150 covers the main body portion 142, any unexpected electrical connection between the conductive wire 122*a* and the main body portion 142 that affects signal transmission may be prevented.

Figure 5:
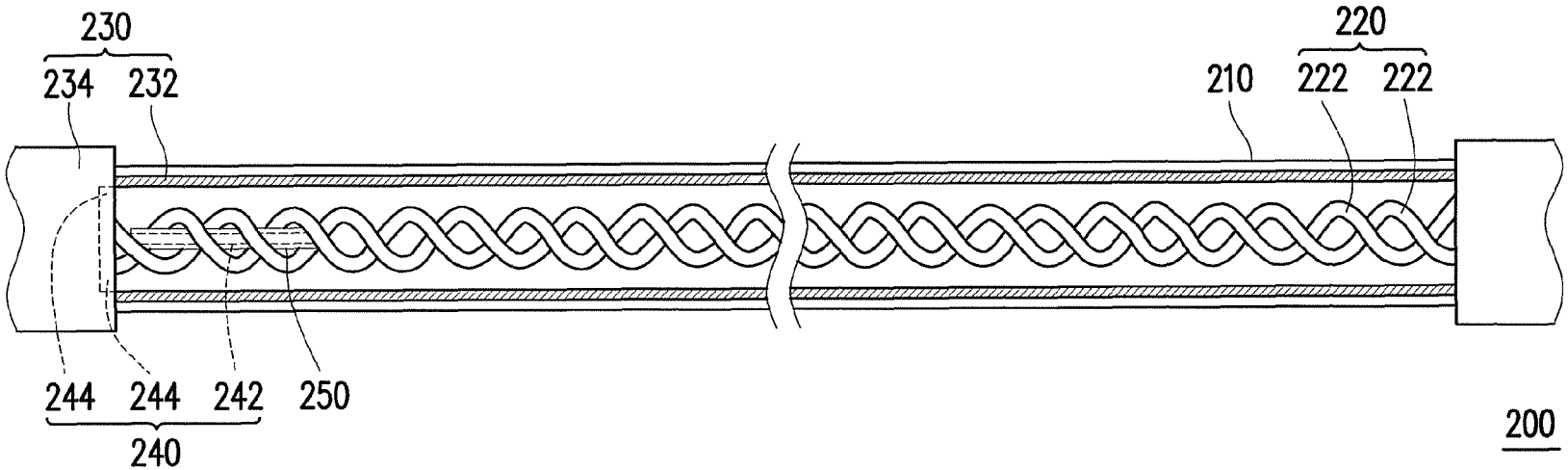
FIG. 5 is a schematic view of a cable according to another embodiment of the invention.

FIG. 5 is a schematic view of a cable according to another embodiment of the invention. In the cable 200 of FIG. 5, the first insulating layer 210, the twisted pair 220, the signal wires 222, the ground structure 230, the metal layer 232, the metal housing 234, the conducting element 240, the main body portion 242, the extending portion 244, and the third insulating layer 250 are configured similar to the first insulating layer 110, the twisted pair 120, the signal wires 122, the ground structure 130, the metal layer 132, the metal housing 134, the conducting element 140, the main body portion 142, the extending portion 144, and the third insulating layer 150 of FIG. 1. The description will not be repeated herein. The difference between the cable 200 and the cable 100 is that the conducting element 240 is disposed at an end of the cable 200 to directly connect to the metal housing 234 of the ground structure 230, so as to achieve a grounding effect.

Figure 6:
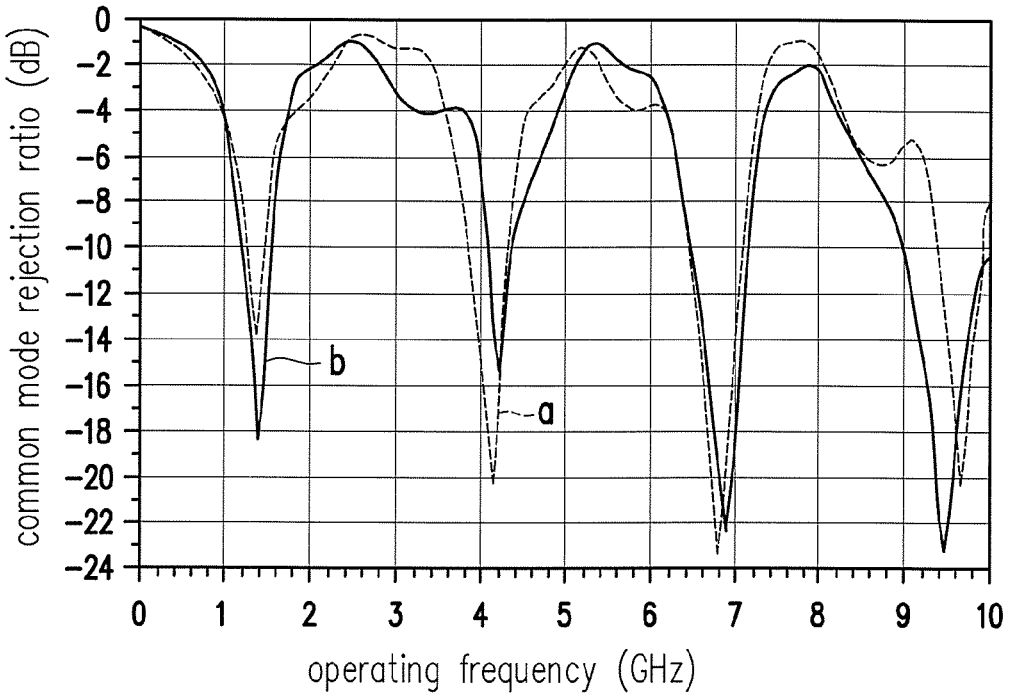
FIG. 6 is a schematic comparison diagram of the effects of filtering a common mode signal between the conducting element of FIG. 1 and the conducting element of FIG. 5.

FIG. 6 is a schematic comparison diagram of the effects of filtering a common mode signal between the conducting element of FIG. 1 and the conducting element of FIG. 5. The curve a represents the common mode rejection ratio of the conducting element 140 of FIG. 1 at different operating frequencies. The curve b represents the common mode rejection ratio of the conducting element 240 of FIG. 5 at different operating frequencies. As seen in FIG. 6, the difference of the common mode rejection ratio between the curve a and the curve b at different frequencies is not very great. That is to say, the effect of filtering the common mode signal by the conducting element does not vary greatly from disposing the conducting element at different locations. Thus, the configuration position of the conducting element can be determined according to the convenience of the user during manufacture and assembly, without affecting the ability of filtering the common mode signal.

Figure 7:
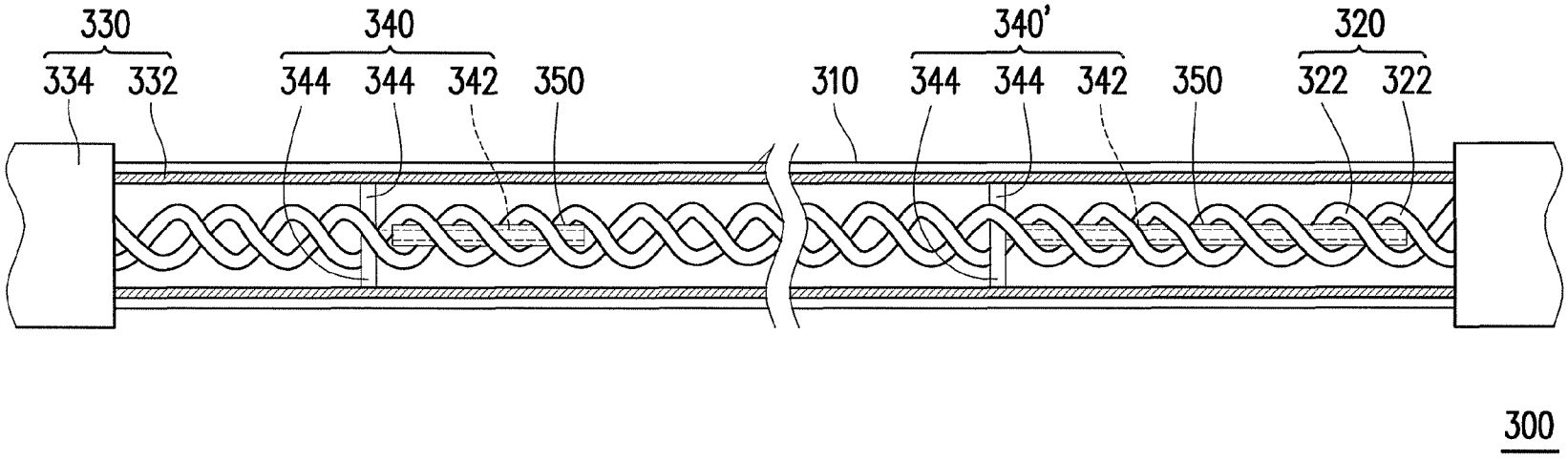
FIG. 7 is a schematic view of a cable according to another embodiment of the invention.

FIG. 7 is a schematic view of a cable according to another embodiment of the invention. In the cable 300 of FIG. 7, the first insulating layer 310, the twisted pair 320, the signal wires 322, the ground structure 330, the metal layer 332, the metal housing 334, the conducting element 340, the conducting element 340', the main body portion 342, the extending portion 344, and the third insulating layer 350 are configured similar to the first insulating layer 110, the twisted pair 120, the signal wires 122, the ground structure 130, the metal layer 132, the metal housing 134, the conducting element 140, the main body portion 142, the extending portion 144, and the third insulating layer 150 of FIG. 1. The description will not be repeated herein. The difference between the cable 300 and the cable 100 is that the cable 300 includes a plurality of conducting elements (shown as the conducting element 340 and the conducting element 340'). The length of the main body portion 342 of the conducting element 340 is different from the length of the main body portion 342 of the other conducting element 340'. Thus, the cable 300 respectively utilizes two conducting elements 340, 340' at different operating frequencies to filter the common mode signal of the twisted pair 320, as described below.

Figure 8:
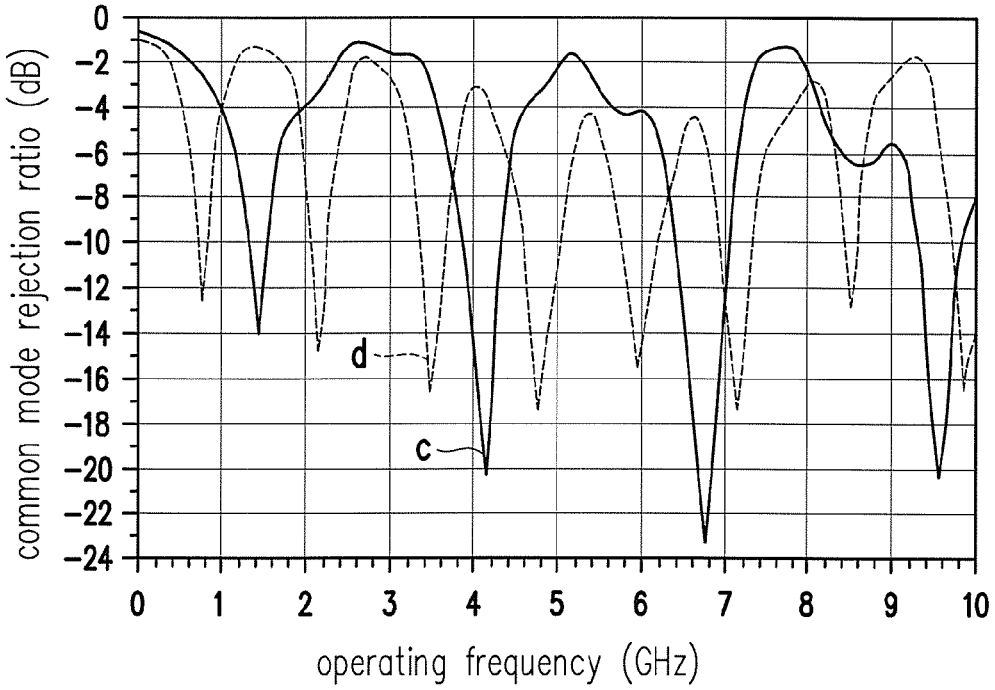
FIG. 8 is a schematic comparison diagram of the effects of filtering a common mode signal between two conducting elements of FIG. 7.

FIG. 8 is a schematic comparison diagram of the effects of filtering a common mode signal between two conducting elements of FIG. 7. The curve c represents the common mode rejection ratio of the conducting element 340 of FIG. 7 at different operating frequencies. The curve d represents the common mode rejection ratio of the conducting element 340' of FIG. 7 at different operating frequencies. As seen in FIG. 8, the curve c generates a response at the operating frequencies 1.4 GHz, 4.1 GHz, 6.8 GHz, and 9.6 GHz. This means that the conducting element 340 filters the common mode signal at these operating frequencies. The curve d generates a response at the operating frequencies 0.7 GHz, 2.1 GHz, 3.4 GHz, 4.8 GHz, 6.0 GHz, 7.2 GHz, 8.5 GHz, and 9.9 GHz. This means that the conducting element 340' filters the common mode signal at these operating frequencies. That is to say, the conducting element 340 and the conducting element 340' have different electrical properties because of the difference in length, or the differences in inductance and resistance. Thus, the conducting element 340 and the conducting element 340' filter common mode signals at different operating frequencies. In detail, the length of the main body portion 342 of the conducting element 340' is, for example, double the length of the main body portion 342 of the conducting element 340. The number of frequency responses in the curve d as shown in FIG. 8 is double the amount of frequency responses in the curve c. The user may design the length of the conducting element according to need by referring to the relationship between the amount of frequency responses and the length of the conducting element as described above. In addition, in other embodiments, the conducting elements may also have different electrical properties by respectively having different material or shapes. This way, the conducting elements may filter common mode signals at different operating frequencies. The invention is not limited thereto.

Figure 9:
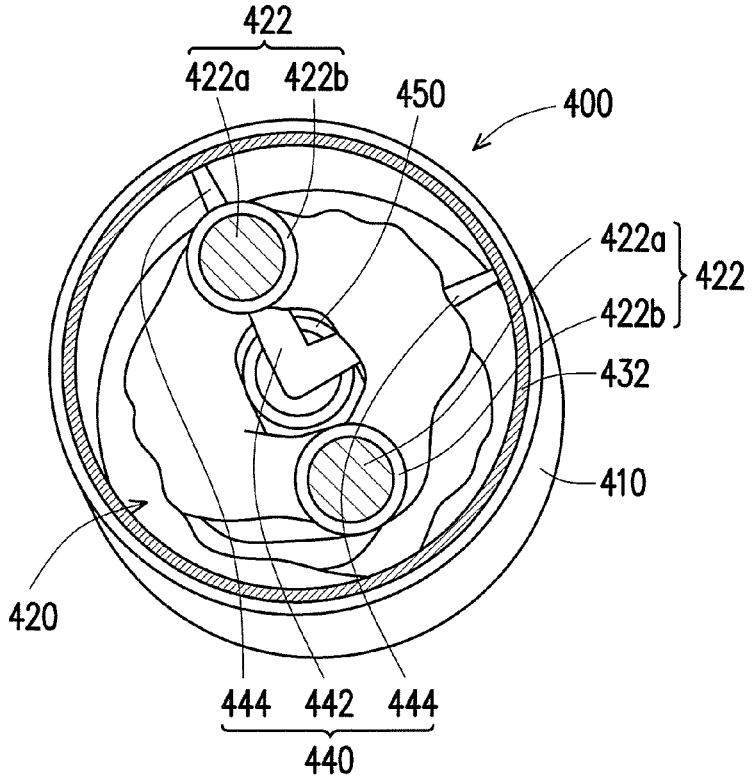
FIG. 9 is a partial three-dimensional diagram of a cable according to another embodiment of the invention.

FIG. 9 is a partial three-dimensional diagram of a cable according to another embodiment of the invention. In the cable 400 of FIG. 9, the first insulating layer 410, the twisted pair 420, the signal wires 422, the conductive wire 422*a*, the second insulating layer 422*b*, the metal layer 432, the conducting element 440, the main body portion 442, the extending portion 444, and the third insulating layer 450 are configured similar to the first insulating layer 110, the twisted pair 120, the signal wires 122, the conductive wire 122*a*, the second insulating layer 122*b*, the metal layer 132, the conducting element 140, the main body portion 142, the extending portion 144, and the third insulating layer 150 of FIG. 3. The description will not be repeated herein. The difference between the cable 400 and the cable 100 is that the two extending portions 144 of the conducting element 140 extend in opposite directions. However, the two extending portions 444 of the conducting element 440 respectively extend in directions perpendicular to each other. In other embodiments, the extending portions of the conducting element can extend in other suitable directions, or extend in a curved shaped. The invention is not limited thereto.

Figure 10:
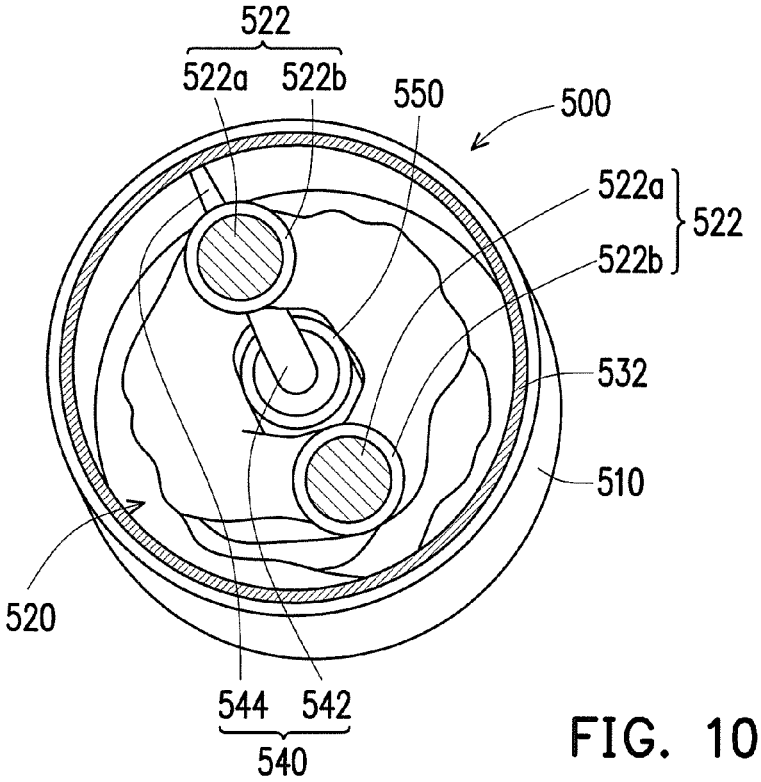
FIG. 10 is a partial three-dimensional diagram of a cable according to another embodiment of the invention.

FIG. 10 is a partial three-dimensional diagram of a cable according to another embodiment of the invention. In the cable 500 of FIG. 10, the first insulating layer 510, the twisted pair 520, the signal wires 522, the conductive wire 522*a*, the second insulating layer 522*b*, the metal layer 532, the conducting element 540, the main body portion 542, the extending portion 544, and the third insulating layer 550 are configured similar to the first insulating layer 110, the twisted pair 120, the signal wires 122, the conductive wire 122*a*, the second insulating layer 122*b*, the metal layer 132, the conducting element 140, the main body portion 142, the extending portion 144, and the third insulating layer 150 of FIG. 3. The description will not be repeated herein. The difference between the cable 500 and the cable 100 is that the conducting element 140 includes two extending portions 144. However, the conducting element 540 only includes one extending portion 544. In other embodiments, the amount of the extending portions of the conducting element can be any other suitable amount. The invention is not limited thereto.

To sum up, in the cable of the invention, the conducting element is disposed between the two signal wires of the twisted pair, and the conducting element is grounded. Accordingly, the conducting element can filter a common mode signal of the twisted pair. This allows the differential mode signal of the twisted pair to not be distorted, which improves the signal integrity of the cable. Thus, the problems of EMI or RFI are reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A cable, comprising:

a first insulating layer;

a twisted pair; disposed in the first insulating layer and comprising two signal wires, wherein the two signal wires are intertwisted with each other;

a ground structure; disposed at the first insulating layer; and at least one conducting element, comprising a main body portion and at least one extending portion, wherein the main body portion is disposed in the twisted pair such that a periphery of the main body is surrounded by the two signal wires, and the at least one extending portion is connected to the main body portion and grounded to the ground structure.

2. The cable as claimed in claim 1, wherein the ground structure comprises a metal layer, the metal layer is disposed at an inner wall of the first insulating layer, and the at least one extending portion extends out of the twisted pair to connect to the metal layer.

3. The cable as claimed in claim 1, wherein the ground structure comprises a metal housing, the metal housing is disposed at an end of the first insulating layer, and the conducting element is connected to the metal housing.

4. The cable as claimed in claim 1, wherein the at least one extending portion is a plurality of extending portions, and the extending portions respectively extend along different directions to connect to the ground structure.

5. The cable as claimed in claim 1, wherein the at least one conducting element is a plurality of conducting elements, and a length, material, or shape of the main body portion of one of the conducting elements is different from a length, material, or shape of the main body portion of another one of the conducting elements.

6. The cable as claimed in claim 1, wherein the two signal wires are symmetric about the main body portion.

7. The cable as claimed in claim 1, wherein each of the signal wires comprises a conductive wire and a second insulating layer, and the second insulating layer covers the conductive wire.

8. The cable as claimed in claim 1, further comprising at least one third insulating layer, wherein the at least one third insulating layer covers the main body portion of the conducting element.

* * * * *